US005413287A

United States Patent [19]

Telsnig

[11] Patent Number: 5,413,287

[45] Date of Patent: May 9, 1995

[54] CHOPPING DEVICE, PARTICULARLY FOR HOUSE AND GARDEN WASTES

[76] Inventor: Adolf Telsnig, Gartenstrasse 9, D-34125 Kassel, Germany

[21] Appl. No.: 153,175

[22] Filed: Nov. 16, 1993

[30] Foreign Application Priority Data

Nov. 18, 1992 [DE] Germany ..... 9215679 U

[51] Int. Cl.[6] ..... B02C 18/06; B02C 18/10

[52] U.S. Cl. ..... 241/46.17; 241/92; 241/101.7; 241/162; 241/282.2

[58] Field of Search ..... 241/46.02, 46.06, 46.08, 241/46.13, 46.17, 92, 101.7, 152.2, 162, 282.1, 282.2

[56] References Cited

U.S. PATENT DOCUMENTS

| | | | |
|---|---|---|---|
| 2,980,348 | 4/1961 | Jordan | 241/46.08 |
| 3,486,702 | 12/1969 | Kmeco | 241/46.17 |
| 3,601,324 | 8/1971 | Brown . | |
| 3,897,019 | 7/1975 | Klein et al. . | |
| 4,360,166 | 11/1982 | Biersack | 241/92 |
| 4,593,861 | 6/1986 | Blakley et al. | 241/46.02 |
| 4,595,148 | 6/1986 | Luerken et al. | 241/92 |
| 4,778,117 | 10/1988 | Karg | 241/92 |

FOREIGN PATENT DOCUMENTS

| | | |
|---|---|---|
| 1025196 | 5/1958 | Germany . |
| 3217433 | 5/1985 | Germany . |
| 3612997 | 10/1987 | Germany . |
| 1428467 | 10/1988 | U.S.S.R. . |

*Primary Examiner*—Timothy V. Eley
*Attorney, Agent, or Firm*—Michael J. Striker

[57] ABSTRACT

A chopping device for chopping waste material, in particular household and garden wastes, has a housing having a filling opening and a discharging opening for a waste material, a rotor rotatably supported in the housing between the filling opening and the discharging opening and having a substantially vertical rotary axis and also having at least one throughgoing gap, a rotary drive for rotating the rotor about the rotary axis, at least one cutter provided at an upper side of the rotor and at least one driver provided at a lower side of the rotor, and at least one holding element for the waste material cooperating with the rotor. The rotor is funnel-shaped and has a side wall which is provided with the throughgoing gap and the cutter and a central bottom part which is connected with the rotary drive and from which the side wall projects upwardly and outwardly toward the filling opening so as to expand substantially conically.

16 Claims, 5 Drawing Sheets

CHOPPING DEVICE, PARTICULARLY FOR HOUSE AND GARDEN WASTES

BACKGROUND OF THE INVENTION

The present invention relates to a chopping device, particularly for house and garden wastes.

More particularly, it relates to such a chopping device which has a housing with a filling opening and a discharging opening for a waste material, a rotor rotatable in the housing between the openings and having a cutter and a driver, and a holding element for the waste material cooperating with the rotor.

Chopping devices of the above mentioned general type are known in many modifications. One of such chopping devices is disclosed for example in the German reference DE 36 12 997 A1. Since these devices are used in households and gardens, many variants of the devices are cost-favorable. However, frequently they are less satisfactory in the sense of the cutting power and disturbance-free operation for example due to clamping and clogging. When the chopping devices are sufficiently disturbance-free and power efficient, then they are relatively expensive and therefore not suitable for public purpose or the like, such for example for households and gardens.

In order to avoid these disadvantages another chopping device was proposed in the German document DE 32 17 322 C2. The chopping device disclosed in this reference has a truncated cone-shaped rotor. This chopping device however has a tendency, especially during its use for soft and moist waste materials, for example those containing leaves or grass, to be clamped or clogged primarily in the region of the radial gap between the outer, lower edge portion of the rotor and the surrounding housing wall. Thereby either the cutting power is reduced or it must be provided with a relatively greater ring gap to avoid clogging, which of course unfavorably influences the comminuting action.

SUMMARY OF THE INVENTION

Accordingly, it is an object of the present invention to provide a chopping device of the above mentioned type, which is disturbance-free and power efficient and at the same time can be produced at a relatively low cost.

In keeping with these objects and with others which will become apparent hereinafter, one feature of the present invention resides, briefly stated, in a chopping device of the above mentioned general type, in which the rotor is formed funnel-shaped and has a side wall which is provided with a throughgoing gap and the cutter, which side wall substantially conically extends from a central bottom part connected with the rotary drive upwardly and outwardly to the filling opening.

When the rotor of the chopping device has a funnel shape and at the same time is provided at its inner side with cutters and throughgoing gaps, a very efficient treatment of the waste material is performed. During operation the waste material is accumulated in the funnel. Under the action of the generated centrifugal forces it is pressed outwardly against the side wall, comminuted by the cutters, and transported outwardly through the throughgoing gaps so as to be supplied to a discharge shaft. The geometry of the throughgoing gaps and cutters is adjustable in a simple manner and can be selected so that it provides a high cutting power. Formation accumulations and therefore clamping or clogging are not possible. In contrast to a truncated cone-shaped rotor, the waste material is always accelerated radially outwardly and upwardly until it completes comminution and reflected on the surrounding housing walls to the central axis, so that a complete circulation takes place and the comminuted material is again supplied to the region of the cutters and through-going gaps until it is sufficiently comminuted and discharged through the throughgoing gaps. In this manner, the centrifugal forces and the force of gravity are used in an optimal manner during the operation.

In accordance with the further feature of the present invention, the rotor can be provided with two diametrically opposite cutters.

In accordance with still another feature of the invention, the housing portion which surrounds the rotor is substantially cylindrical, while the rotor extends with its upper end of its side wall closely to this housing portion. A gap remaining between the housing portion and the upper end of the side wall extends to the lower end of a loading shaft provided with the filling opening. Also, the side wall can have a cylindrical edge portion extending parallel to the housing portion.

The cutters can be arranged radially between the bottom parts connected with the rotary drive and the edge portion of the side wall. Also, the cutters can be formed as planing knives.

In accordance with a still further feature of the present invention, the rotary drive can be formed to provide the rotation of the rotor in opposite rotary directions. The cutters can be designed so that they are suitable for one direction and another direction. The cutters for at least one of the two opposite rotary directions can be provided with corresponding cutting edges.

Finally, the rotor can be provided in its center with a comminutor for comminuting of the waste material or with a drawing-in cone.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
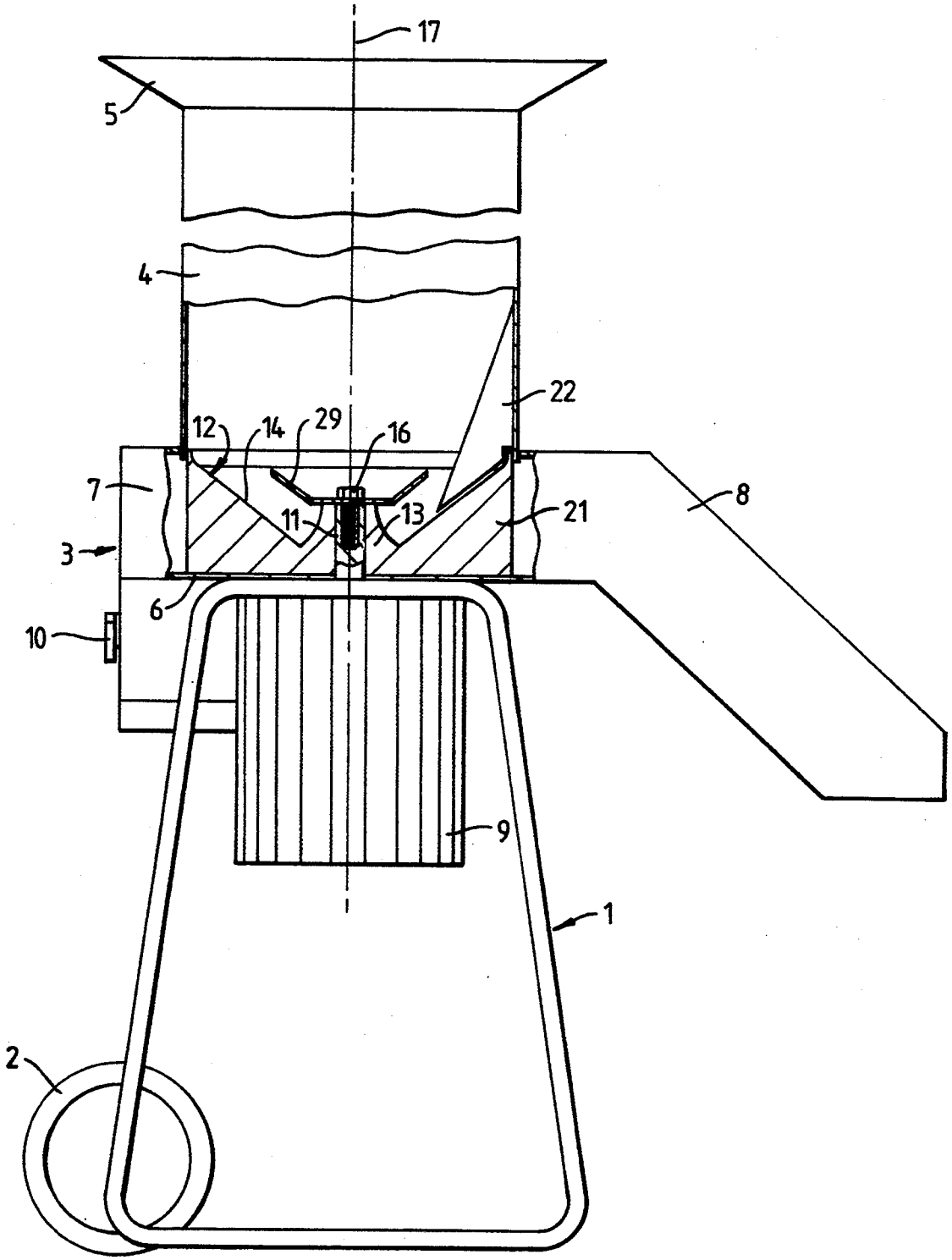
FIG. 1 is a schematic, partially sectioned side view of a chopping device, in accordance with the present invention.
Figure 2:
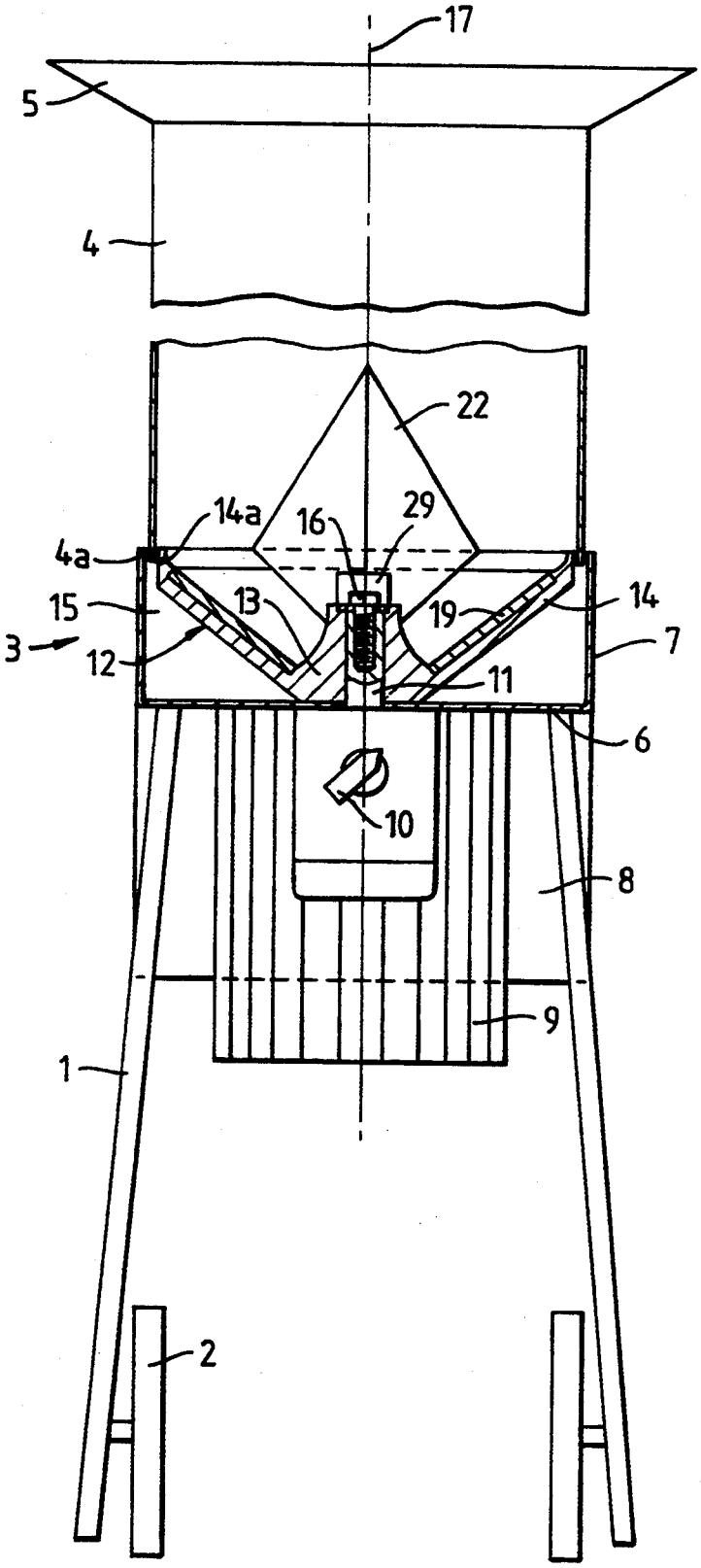
FIG. 2 is a front view of the chopping device of FIG. 1, also partially sectioned.
Figure 3:
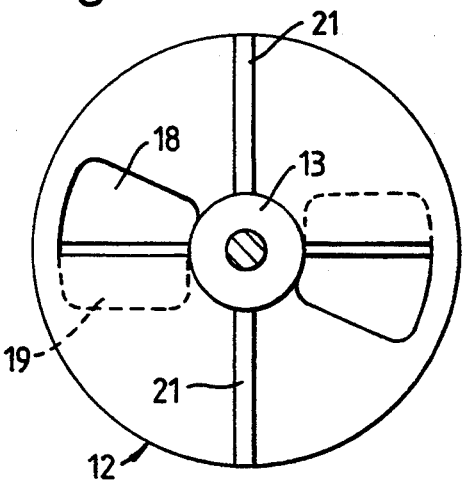
FIG. 3 is a bottom view of a rotor of the chopping device in accordance with the present invention shown in FIGS. 1 and 2.

As can be seen from FIGS. 1 and 2, a chopping device in accordance with the present invention is supported on a frame 1 with a plurality of rotatably mounted running rollers for conveniently transporting the chopping device in an inclined position of the frame 1. The frame 1 carries a housing 3 which is for example hollow cylindrical and provided on its upper end with a loading shaft 4 having an inlet funnel 5. An inner side of the housing 3 is provided with a supporting plate 6 which is for example circular. During the operation of the chopping device it has a substantially horizontal position. A substantially cylindrical portion 7 of the housing 3 projects from the supporting plate 6 upwardly. A radially outwardly extending discharging opening is formed in the portion 7. A discharge shaft 8 or a similar structure for the comminuted, material can be connected with° a discharging opening.

A rotary drive 9 is mounted on the lower side of the supporting plate 6. The rotary drive can be formed as an electric motor or an internal combustion engine. It is turned on and off by a switch 10 and has a drive shaft 11 which extends substantially vertically through an opening formed in the supporting plate 6, upwardly beyond the supporting plate.

A rotor 12 is rotatably supported in a not shown bearing above the supporting plate 6 and has a funnel shape. It can be seen that the rotor 12 is composed of an upwardly open cup with a bottom part 13 having a smaller diameter than the supporting plate 6 and also having a similar circular cross-section. An upwardly and outwardly inclined surface or side wall 14 extends from the bottom part 13. It is coaxial to the portion 7 of the housing 3 and has an upper, outer edge portion which is spaced from the portion 7 only by a small annular gap. Underneath the side wall 14, the portion 7 and the supporting plate 6 of the housing 3 form a substantially closed chamber is which is open only through a discharging opening to the discharge shaft 8.

The upwardly projecting part of the drive shaft 11 extends through the supporting plate 6 into a central opening formed in the bottom part 13 of the rotor 12. This part serves for fixed connection of the rotary drive 9 with the rotor 12. For example, the rotor 12 can be supported on a not shown shoulder of the drive shaft 11 and the mounting can be performed by a screw 16. The screw is screwed into an axial threaded opening of the drive shaft 11 and has a head which is supported on the upper side of the bottom part 13.

The chopping device has a central axis 17. The central axis preferably is also a rotary axis around which the drive shaft 11 and thereby the rotor 12 rotates when the rotary drive 9 is turned on by the switch 10.

As can be seen from FIGS. 3–6, the side wall 14 has preferably several throughgoing gaps 18, for example two diametrically-opposite throughgoing gaps. The gaps are inclined relative to the vertical central axis 17 of the chopping device. Cutters 19 are mounted for example by screws on the trailing rear edges of the throughgoing gaps 18 as considered in the rotary direction of the rotor 12 identified with the arrow v in FIG. 4. The cutters 19 can be formed for example as planing cutters. Therefore the trailing edges of the throughgoing gaps 18 are provided with the forwardly extending blade 20 as considered in the rotary direction. As a result a planing effect is produced as in conventional planing tools, and the cutters 19 act analogously to the action of a planing tool in a chip-removing manner on for example knots, branches or the like supplied into the loading shaft 4, while the removed tips can be discharged through the throughgoing gaps 18 outwardly into the chamber 15. There the comminuted material is supplied to the region of drivers 21 provided on the lower side of the side wall 14 of the rotor 12 at distances from one another and composed for example of ribs. The ribs can be preferably formed of one piece with the rotor 12 and extend closely to the portion 7 of the housing 3. In the shown embodiment two such drivers 21 are arranged at an angular distance of 180° and offset by 90° relative to the throughgoing gaps 18. The comminuted material which passed the throughgoing gaps 18 is entrained by the drivers 21 and displaced to the region of the discharging opening by centrifugal forces into the discharge shaft 8.

The cutters 19 cooperate during the operation with a substantially wedge-shaped holding element 22. The holding element is preferably mounted above the portion 7 on the inner wall of the loading shaft 3 and its relative position with respect to the rotor 12 is schematically identified in FIGS. 4–6. The holding element 22 extends into the funnel-shaped rotor 12 and has preferably a lower edge 23 shown in FIG. 5. The lower edge extends parallel to the side wall 14 at a small distance and projects in a radial direction from the portion 7, for example substantially over the half or somewhat longer with respect to the side wall 14 as shown in FIG. 5. The cutters 19 are arranged preferably in radial pockets of the side wall 14 so that they can run under the lower edge 23 as shown in FIG. 6. The operation of the holding element 22 prevents a co-rotation of the material to be comminuted inside the loading shaft 4 and thereby permits its fast comminution. Moreover, the holding element 22 during rotation of the rotor 12 operates for catching a not sufficiently comminuted material which is thrown upwardly and radially outwardly from the side wall 14 and the cutters 19, and thereby under the action of gravity it falls back again into the funnel-shaped rotor 12.

Figure 4:
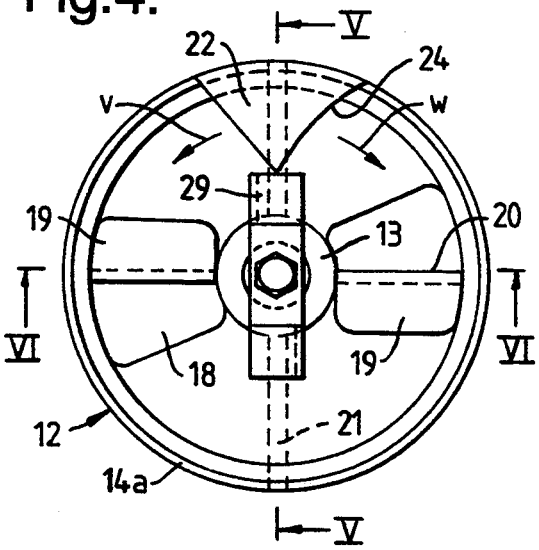
FIG. 4 is a plan view of the rotor of the inventive chopping device of FIG. 3, with a schematically shown holding element.
Figure 5:
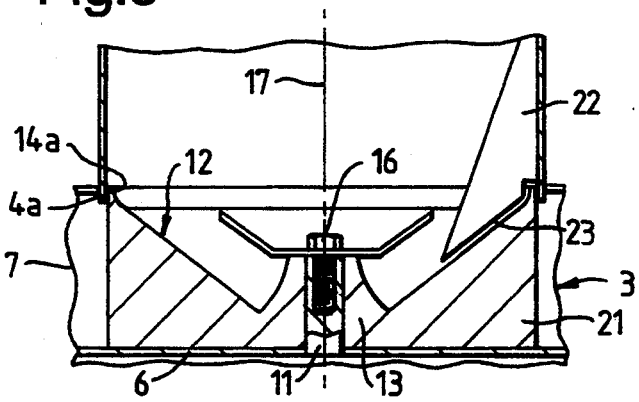
FIGS. 5 and 6 are views showing sections of the inventive hopping device, taken along the lines V—V and VI—VI in FIG. 4.
Figure 6:
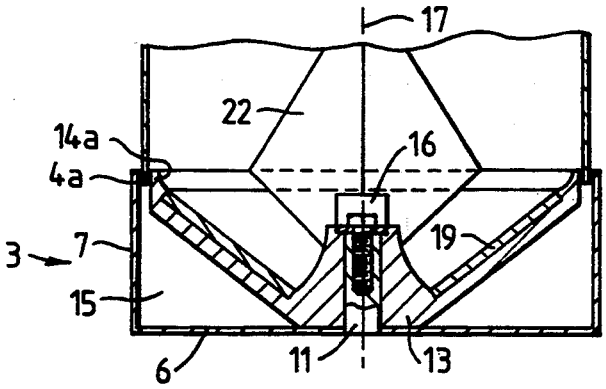
Figure 7:
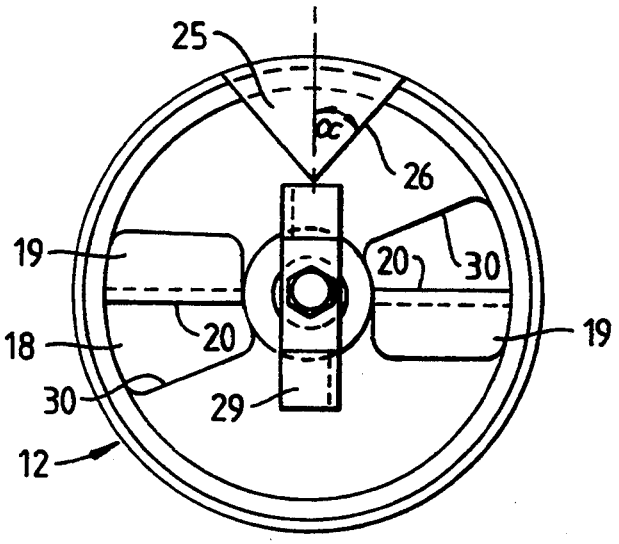
FIGS. 7 and 8 are two plan views corresponding to FIG. 4 of the rotor of the inventive chopping device, in accordance with two further embodiments of the holding element.
Figure 8:
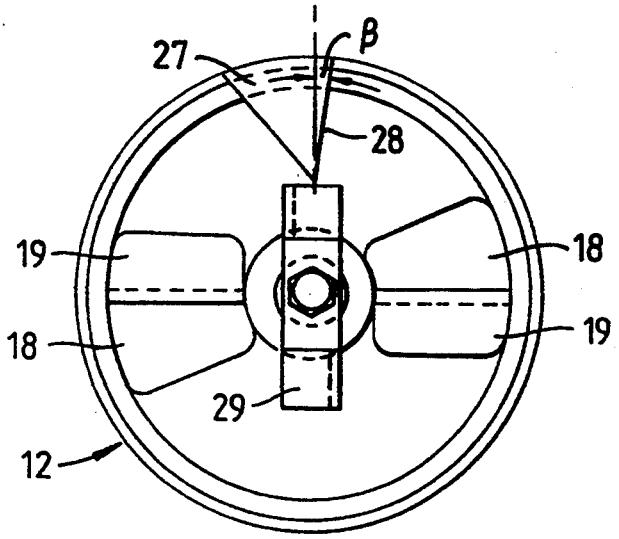

The wedge-shaped holding element 22 shown in FIGS. 4–6 has a side face 24 provided on its side which faces the blade 20 of the passing cutter 19 and insignificantly concave and curved inwardly. A holding element 25 shown in FIG. 7 with the same construction of the chopping device has a flat side surface 26 which forms with an associated radius a relatively great angle $\alpha$. FIG. 8 shows to the contrary a holding element 27 with a side face 28 which faces the running blade 20 of the cutter 19 and is also substantially flat and forms with the associated radius a substantially smaller angle $\beta$. Due to the preferable arrangement and shape of the corresponding holding element, the chopping process can be further optimized.

A comminutor 29 shown in FIGS. 1, 4 and 5 is provided on the bottom part 13 of the rotor. The comminutor can be conical, star-shaped or T-shaped. The comminutor operates in addition to the operation of the cutters 19 and for example provides a preliminary comminution of the waste material.

The above described comminuting device is utilized preferably for cutting of brush wood and trees with predominantly wooden material which is supplied during rotation of the rotor 12 through the filling funnel 5 and the loading shaft 4.

In order to avoid the situation that the cutter 19 becomes blunt too quickly during working of soft materials, for example leaves, newspapers, kitchen wastes, etc., in accordance with the present invention a rotary drive 9 is utilized, which with a corresponding adjustment of the switch 10 can be turned in direction of an arrow w in FIG. 4, or in other words, opposite to the arrow v. In this case the rotor 12 acts not with its cutters 19, but instead with further cutters or exposed cutting edges on the waste material. The cutting edges can be formed for example on the edges 30 of the throughgoing gaps 18 which are opposite to the cutters 19 as shown in FIG. 4.

In the embodiment shown in FIGS. 1–6 which is the best embodiment so far, the side wall 14 on its radially outwardly located side is provided with a vertically upwardly extending cylindrical edge portion 14*a* which is parallel to the portion 7 of the housing 3. The edge portion 14*a* forms with the portion 7 a ring gap. The loading shaft 4 is inserted into the ring gap at a lower end 4*a* as shown in FIGS. 5 and 6. Thereby an additional advantage is provided in that the not sufficiently comminuted material which is thrown from the side wall 14 or the cutters 19 radially outwardly and upwardly, does not penetrate into the ring chamber formed between the portion 7 and the side wall 14 and therefore does not cause clamping, clogging, ramming, etc. there. The whole material is thrown inclinedly upwardly, is reflected at the inner wall of the loading shaft 4 and then transported back from there into the funnel-shaped rotor 12, so that it is continuously recirculated and thereby substantially improves the comminuting action even in the presence of leaves, grass, etc.

Figure 9:
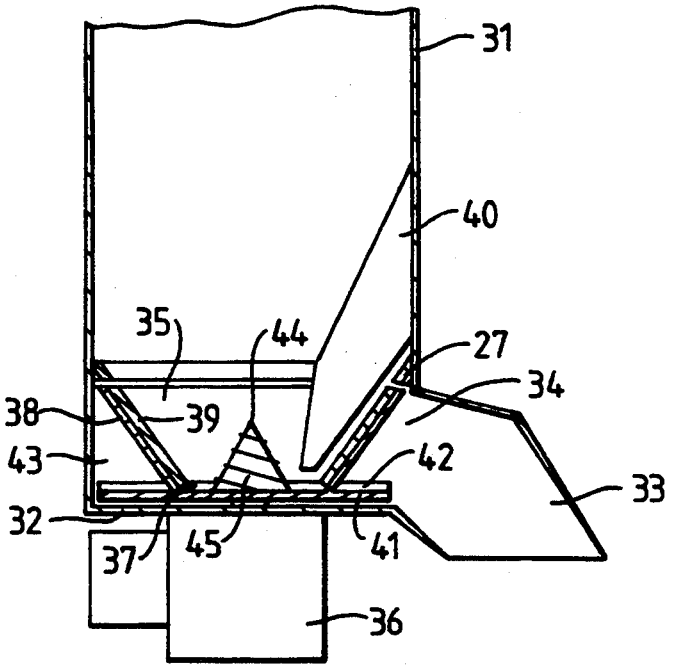
FIG. 9 is a view showing a vertical section which corresponds substantially to FIG. 2 but is only partially sectioned through the inventive chopping device in accordance with a second embodiment.

In the embodiment schematically shown in FIG. 9 the chopping device is provided with a hollow cylindrical loading shaft 31 which is closed at its lower end with a supporting plate 32 extending substantially horizontally during the operation and having a discharging opening 34 which opens in a discharge shaft 33. A funnel-shaped rotor 35 is rotatably supported on the supporting plate 32 analogously to the embodiment of FIGS. 1–6, and coupled with a rotary drive 36. The rotor 35, similarly to the rotor 12 of FIGS. 1–6, is provided with a bottom part 37 and a side wall 38 extending from it inclinedly upwardly and outwardly. The side wall 38 has not shown throughgoing gaps and cutters 39 on its inner side. A holding element 40 is formed in accordance with the embodiments of FIGS. 4, 7 or 8.

In contrast to FIGS. 1–6, the bottom part 37 of the rotor 35 does not only extend to the beginning of the side wall 38, but instead is extended up to the cylindrical inner wall of the loading shaft 31. The circular extension 41 formed thereby is provided with radial, rib-shaped drivers 42 located at distances from one another. The drivers catch the comminuted chopped product which exits through the throughgoing gaps of the side wall 38 into a chamber 43 between the inner wall of the loading shaft 31 and the outer side of the side wall 38. The drivers transport this chopped product to the discharging opening 34 through which it is thrown by the centrifugal force into the discharge shaft 31.

As an alternative to the comminutor 39 shown in FIGS. 1–6 a cone 44 can be located in the center of the bottom part 37 of the rotor 35. Its conical surface has a raised spiral shaped rib 45 which contributes during rotation of the rotor 35 to an automatic drawing of the waste material in one direction. Alternatively, also the embodiment of FIGS. 1–6 can be provided, in accordance with which the rotor 35 can be selectively rotated in opposite directions.

Figure 10:
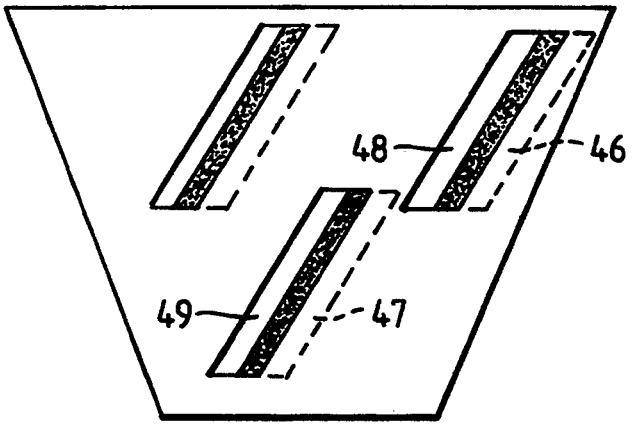
FIG. 10 is a schematic inner view of a part of a further embodiment of the rotor for the chopping device of FIGS. 1–8.

FIG. 10 shows an embodiment with the number, size and angular inclination of the cutters 46 and 47 which are different from those of the embodiment of FIGS. 1–6. The cutter portions which at least partially cover the associated throughgoing gaps 48 and 49 are identified in black. Moreover, FIG. 10 shows a view from inside onto a part of the side wall of a rotor formed in accordance with FIGS. 1–6.

In FIG. 10 two rows of the cutters 46 and 47 are arranged over one another. Similarly to the associated throughgoing gaps 48 and 49, they are inclined to the generatrix of the funnel-shaped side wall so that their upper ends during rotation of the rotor always follow the lower ends. Moreover, the cutters 46 and 47 and the gaps 48 and 49 extend only over substantially a half the height of the side wall of the rotor, while simultaneously the cutter 47 and the throughgoing gap 49 are located between the cutters 46 and throughgoing gaps 48. Thereby the engaging length of the cutters 46, 47, at the waste material is smaller, which contributes to a quiet, impact-free running of the motor.

Alternatively, also three rows of the cutters and the throughgoing gaps can be provided. One part of the cutters can operate for the rotation of the rotor in one direction, while another part of the cutters can operate for the rotation of the rotor in the opposite direction. Moreover, the planing cutter can extend substantially over one-third of the height of the associated side wall, and in some cases with a corresponding offset from one row to another so that the cutters during rotation of the rotor come into action not simultaneously, but instead successively after one another.

The shapes and sizes of the funnel-shaped rotors can be of course different. In all cases it is preferable to provide throughgoing gaps which are closed at both ends, so that closed side wall portions are produced at their upper and lower ends to guarantee the required mechanical stability of the rotors or their side walls. The size of the throughgoing openings can be selected greater or smaller in dependence on the required comminuting power.

The present invention is not of course limited to the shown embodiments which can be changed in a simple manner and used in any combination with one another. This is true on the one hand for the number, size and inclination of the cutters or throughgoing gaps, and on the other hand for the distances between blades 20 or similar cutting edges of the side wall which are adjusted perpendicular to the associated side wall and determine the cutting depth. The cutters can be arranged adjustably in the side walls for providing different distances. The ratios selected in each individual case are selected first of all in view of the desired cutting power, a quiet running of the rotor, and the desired service life of the cutters, or adjusted to the corresponding requirements, wherein correspondingly the presence of a single cutter or driver for the above described operation is sufficient.

Furthermore, it is possible to produce in particular the cutting edges so that the rotors are made of metal casting and the front edges of the throughgoing gaps are cast perpendicularly to the inner upper surface of the side wall deeper or the rear edges are cast correspondingly higher. Further, it is possible to select any angle of inclination between 0° and 90° for the side walls 14, 38 relative to the bottom part 13, 37, and the inclination angle preferably must be selected between 20° and 70°. Further, the construction of loading shaft 4 and 31 and the type and the mounting of a rotary drive for the rotor 12 and 35 can be selected in many possible ways. The same is true for the distances from the holding element 22, 25, and 40 from the side wall 14 or 38. Finally, the axes of the throughgoing gaps can be preferably inclined to the inner or outer sides of the side walls 14 and 38, so that during the rotation of the rotor 12 and 35 they produce at high rotary speeds (for example approximately 2800 revolutions per minute) a suction which throws the separated chips outwardly.

It will be understood that each of the elements described above, or two or more together, may also find a useful application in other types of constructions differing from the types described above.

While the invention has been illustrated and described as embodied in a chopping device for chopping waste material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chopping device for chopping waste material, in particular household and garden wastes, the device comprising a housing (3) having a filling opening for waste material; a rotor (12, 35) rotatably supported in said housing below said filling opening and having a substantially vertical rotary axis (17); a rotary drive for rotating said rotor about said rotary axis; said rotor (12, 35) being funnel-shaped and having a central bottom part (13, 37) which is connected with said rotary drive and a side wall (14, 38) which projects upwardly and outwardly toward said filling opening so as to expand substantially conically and which side wall is provided with at least one throughgoing gap (18, 48, 49) for comminuted waste material and has at least one cutter provided at an upper side of said wall and at least one driver provided at a lower side of said wall; at least one holding element for the waste material, said holding element extending into said funnel-shaped rotor; and a chamber (15) located underneath said side wall and open to a discharging opening so that sufficiently comminuted waste material substantially is discharged through said throughgoing gap whereas not sufficiently comminuted waste material is thrown radially outwardly and upwardly and then transported back into said funnel-shaped rotor without substantially penetrating a gap between said side wall and said housing.

2. A chopping device as defined in claim 1, wherein said rotor is provided with two such cutters, said cutters being located diametrically oppositely relative to one another.

3. A chopping device as defined in claim 1, wherein said housing has a housing portion which surrounds said rotor and is substantially cylindrical, said side wall of said rotor having an upper end which extends closely to said housing portion.

4. A chopping device as defined in claim 3, wherein said housing portion and said upper end of said side wall form therebetween a space; and further comprising a loading shaft which has said filling opening and a lower end extending into said space.

5. A chopping device as defined in claim 3, wherein said upper end of said side wall has a raised cylindrical edge portion extending parallel to said housing portion.

6. A chopping device as defined in claim 5, wherein said cutter is located between said bottom part and said edge portion.

7. A chopping device as defined in claim 1, wherein said cutter is formed as a planing cutter.

8. A chopping device as defined in claim 1, wherein said bottom part is provided with an extension which extends radially outwardly beyond said bottom part and forms between said extension and said side wall of said rotor a space connected with said discharging opening.

9. A chopping device as defined in claim 1, wherein said rotary drive is a drive formed so as to rotate said rotor in opposite rotary directions.

10. A chopping device as defined in claim 9, wherein said cutter is formed so that it provides cutting when said rotor rotates in any of said two opposite directions.

11. A chopping device as defined in claim 10, wherein said cutter is composed of cutting edges which are operative for cutting in both said rotary directions.

12. A chopping device as defined in claim 1; and further comprising a comminutor located in a center of said rotor and operative for a preliminary comminuting of the waste material.

13. A chopping device as defined in claim 1; and further comprising a drawing-in cone which is arranged in a center of said rotor.

14. A chopping device for chopping waste material, in particular household and garden wastes, the device comprising a housing having a filling opening and a discharging opening for a waste material; a rotor rotatably supported in said housing between said filling opening and said discharging opening and having a substantially vertical rotary axis, said rotor having at least one throughgoing gap; a rotary drive for rotating said rotor about said rotary axis; at least one cutter provided at an upper side of said rotor and at least one driver provided at a lower side of said rotor; and at least one holding element for the waste material cooperating with said rotor, said rotor being funnel-shaped and having a side wall which is provided with said throughgoing gap and said cutter and a central bottom part which is connected with said rotary drive and from which said side wall projects upwardly and outwardly toward said filling opening so as to expand substantially conically, said cutter and said throughgoing gap being arranged inclinedly relative to a generatrix of said side wall.

15. A chopping device for chopping waste material, in particular household and garden wastes, the device comprising a housing having a filling opening and a discharging opening for a waste material; a rotor rotatably supported in said housing between said filling opening and said discharging opening and having a substantially vertical rotary axis, said rotor having at least one throughgoing gap; a rotary drive for rotating said rotor about said rotary axis; at least one cutter provided at an upper side of said rotor and at least one driver provided at a lower side of said rotor; and at least one holding element for the waste material cooperating with said rotor, said rotor being funnel-shaped and having a side wall which is provided with said throughgoing gap and said cutter and a central bottom part which is connected with said rotary drive and from which said side wall projects upwardly and outwardly toward said filling opening so as to expand substantially conically, said throughgoing gap having an axis extending inclinedly relative to an inner side of said side wall.

16. A chopping device for chopping waste material, in particular household and garden wastes, the device comprising a housing having a filling opening and a discharging opening for a waste material; a rotor rotatably supported in said housing between said filling opening and said discharging opening and having a substantially vertical rotary axis, said rotor having at least one throughgoing gap; a rotary drive for rotating said rotor about said rotary axis; at least one cutter provided at an upper side of said rotor and at least one driver provided at a lower side of said rotor; and at least one holding element for the waste material cooperating with said rotor, said rotor being funnel-shaped and having a side wall which is provided with said throughgoing gap and said cutter and a central bottom part which is connected with said rotary drive and from which said side wall projects upwardly and outwardly toward said filling opening so as to expand substantially conically, said throughgoing gap having an axis extending inclinedly relative to an outer side of said side wall.

* * * * *